US006089939A

United States Patent [19]

Dyson

[11] Patent Number: 6,089,939

[45] Date of Patent: Jul. 18, 2000

[54] SPINNING FLEXIBLE THROW TOY

[76] Inventor: David B. Dyson, 2811 San Leandro Blvd., #202, San Leandro, Calif. 94578

[21] Appl. No.: 09/177,433

[22] Filed: Oct. 21, 1998

[51] Int. Cl.[7] ..... A63H 27/00

[52] U.S. Cl. ..... 446/48; 446/46

[58] Field of Search ..... 446/34, 35, 46, 446/47, 48, 61, 62, 65, 66

[56] References Cited

U.S. PATENT DOCUMENTS

| | | | |
|---|---|---|---|
| 802,329 | 10/1905 | Schmitt | 446/62 |
| 3,742,643 | 7/1973 | Keith | 446/46 |
| 3,955,817 | 5/1976 | Davis | 446/36 X |
| 4,143,483 | 3/1979 | Kifferstein et al. | 446/47 |
| 5,083,799 | 1/1992 | Thill | 446/47 X |
| 5,360,363 | 11/1994 | Levin | 446/46 |
| 5,417,602 | 5/1995 | Mcgraw | 446/48 |
| 5,522,753 | 6/1996 | McGraw | 446/36 |
| 5,901,926 | 5/1999 | Zheng | 446/61 X |

*Primary Examiner*—Sam Rimell
*Attorney, Agent, or Firm*—Brian Beverly

[57] ABSTRACT

A flexible spinning throw toy having a top hub and a bottom hub connected by a plurality of flexible straps which, when thrown with a spinning motion imparted to it, bends into an oblate shape. Spinning of the toy creates a gyroscopic effect, allowing it to be thrown accurately for considerable distances. In alternate embodiments the straps are detachably connected to the hubs for removal as needed. The toy can be collapsed for easy portability.

22 Claims, 5 Drawing Sheets

SPINNING FLEXIBLE THROW TOY

BACKGROUND

1. Field of the Invention

The present invention relates to throwing toys for recreational enjoyment, and in particular, to a flexible toy which, when spun, attains stability through a gyroscopic effect, allowing it to be thrown accurately for considerable distances. When the toy is spun, centrifugal force flattens it into a disc shape. The toy is flexible and can be collapsed to be transported conveniently.

2. Background of the Invention

Recreation is a recognized human need, and devices which assist in providing recreational experiences have acknowledged inherent value. People derive particular pleasure from toys which can be thrown and caught.

A great many objects have been invented for throwing, too many to here discuss, but keen interest is generated still by any new device having properties or advantages not before seen.

Spinning toys that fly have been created in many forms, such as flying discs, rings, air foils, and boomerangs. For example, Pastrano, U.S. Pat. No. 4,955,841, discloses a disc-shaped throwing toy having a collapsible shell comprising two symmetrically formed halves and an elastic element coupling opposite sides of the shell. When the toy is thrown, centrifugal force maintains the toy in a substantially flat configuration, but as the toy loses rotational speed, the elastic element draws the sides together to form a spherical configuration.

Lin, U.S. Pat. No. 5,674,102, discloses a shape-changing flying saucer, including a cross-based frame having four sector blades which move radially outwards when the device is thrown into the air with a spinning motion. When the centrifugal force dissipates, spring members pull opposing sector blades toward each other, returning the device to its original configuration.

Heisler, U.S. Pat. No. 3,758,985, discloses a discus toy having an interior which inflates when the toy is thrown with a spin imparted to it. This converts the toy from a disc to a sphere with an orbital ring, changing its aerodynamic characteristics.

A number of toys are configured to make use of the flight properties of air foils, such as Bouchakian, U.S. Pat. No. 5,131,879, which discloses a bi-elliptical flying toy consisting of two vertically spaced elliptical rings. Each ring is made of multiple air foils of differing widths and thicknesses with aesthetically pleasing visual properties. The toy is thrown with a spinning motion and hovers like a helicopter.

McGraw, U.S. Pat. No. 5,522,753, discloses a flying device having staggered parallel air foils. The air foil member includes arced slats which enable the device to fly straight and stay in flight for a longer distance.

Viola, U.S. Pat. No. 5,269,716, discloses a circular air foil and a plurality of radial air foils extending from a central hub. The device performs unique aerodynamic maneuvers when tossed through the air.

Finally, Liston, U.S. Pat. No. 3,565,434, discloses a boomerang having three blades, the tilt of each blade being adjustable.

None of the above prior art devices describes a flying toy having the configuration and unique combination of features found in the present invention, which is a flexible flying toy having a plurality of straps which collapses into a disc shape when thrown with a rotational motion.

SUMMARY OF THE INVENTION

A throw toy, according to the invention, comprises a top hub and a bottom hub spaced from the first. Flexible straps connect the top and bottom hubs and extend outward radially from the hubs, especially upon spinning of the device around the hubs. The straps must have mass sufficiently greater than the mass of the hubs to develop sufficient centrifugal force to move the straps radially outward upon spinning. Accordingly, when the device is thrown and spun, the straps move outward, and the hubs are forced closer together into an oblate shape. The preferred embodiment includes four straps of equal length, the middle portion of each strap weighted greater than the strap ends.

In the preferred embodiment, the straps are integrally connected to the hubs for simplicity of manufacturing. In alternative embodiments, the straps are detachably connected to the hubs so that each strap can be detached from the hub for replacement as required due to normal wear and tear.

The unique configuration of the present invention provides a spinning throw toy with unique and beneficial characteristics. The flexible nature of the straps allows the device to be collapsed for easy carrying, such as in a daypack or suitcase. In spinning flight, the centrifugal force developed by the weighted straps creates a gyroscopic effect, giving the device stability while in flight. The gyroscopic stability of the device and the blade-like cross-sectional configuration of the straps give the device aerodynamic properties sufficient to allow the device to be thrown a substantial distance with accuracy. Variations can be made in the weighting of the several straps surrounding the hubs to create a multitude of wobbling or interesting visual effects.

In another embodiment, buckles are provided at the ends of each strap which are removably locked to the central hubs for quick and easy detachment of the straps from the hubs.

It is therefore an object of the present invention to provide a new spinning throw toy.

It is another object of the invention to provide a flexible spinning throw toy which attains stability when spun through a gyroscopic effect and which can be thrown accurately for substantial distances.

It is still another object of the invention to provide a spinning throw toy which is flexible and can be compactly collapsed for easy portability.

A further object of the invention is to provide a spinning throw toy having straps which are detachable from the central hubs of the toy for replacement of worn straps as needed.

It is yet another object of the invention to provide a new and improved spinning throwable toy which may be manufactured for low cost and provide an attractive alternative to existing aerodynamic and other throwable toys.

It is a still further object of the invention to provide a spinning throw toy having straps detachably connected to central hubs with buckles for easy removal and replacement of any of the straps as needed.

DETAILED DESCRIPTION OF THE ILLUSTRATED EMBODIMENTS

Figure 1:
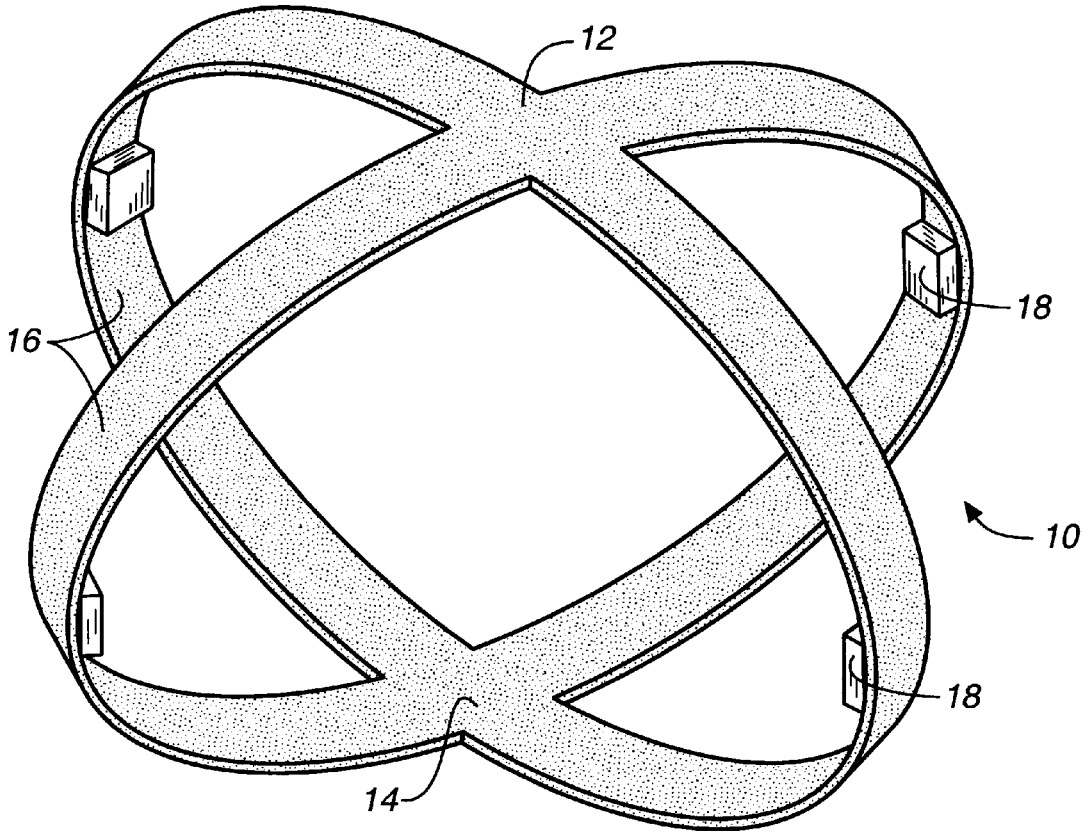
FIG. 1 is a perspective view of a throw toy according to the invention.

A throw toy according to the invention is designated generally in FIG. 1 at 10 and comprises a top hub 12, a bottom hub 14, and a plurality of straps 16 interconnecting the hubs 12, 14. The straps 16 are flexible such that in the preferred embodiment the device can be flattened, bringing the hubs 12, 14 into close proximity or into direct contact with one another. As seen in FIG. 1, the straps 16 are provided with weights 18 such that upon spinning of the straps 16 about the hubs 12, 14, the straps 16 develop centrifugal force. Thus, when the toy 10 is thrown and a spin is imparted to it, the straps 16 move outward radially, the hubs 12 and 14 are brought into closer proximity, and the device 10 moves generally into an oblate shape during flight, resembling a spinning disc.

The connection of the straps 16 to the hubs 12 and 14 must be sufficiently rigid at the point of connection to prevent major circumferential movement of the straps 16, without which it would be difficult to start the device spinning.

It can be seen that the weighting of the straps 16 can be accomplished in a great many different ways, so long as the straps 16 are sufficiently massive to develop enough centrifugal force to move the straps 16 radially outward while spinning to attain gyroscopic stability. For example, weights could be added along the entire length of the straps 16; the weights could be distributed more gradually, so as to more broadly focus weights toward the mid-portion of each strap 16; or weights could be offset from the center of each strap 16 to alter the axis of the spin of the device. In the preferred embodiment shown in FIG. 1, equal weights 18 are placed at the centers of the straps 16 such that the weights of the straps are evenly balanced around the hubs 12, 14. This configuration imparts an even spin to the throw toy 10.

In an alternative embodiment not illustrated, the straps 18 are of different lengths, but opposing straps are of equal length. Alternatively, each strap of each pair of opposing straps is of equal weight, but each pair of opposing straps may have a weight different from another pair of opposing straps.

It can be readily seen that the throw toy 10 could be constructed of any number of straps, so long as the straps are sufficiently massive to develop the centrifugal force necessary to attain the gyroscopic spin of the device.

Figure 4:
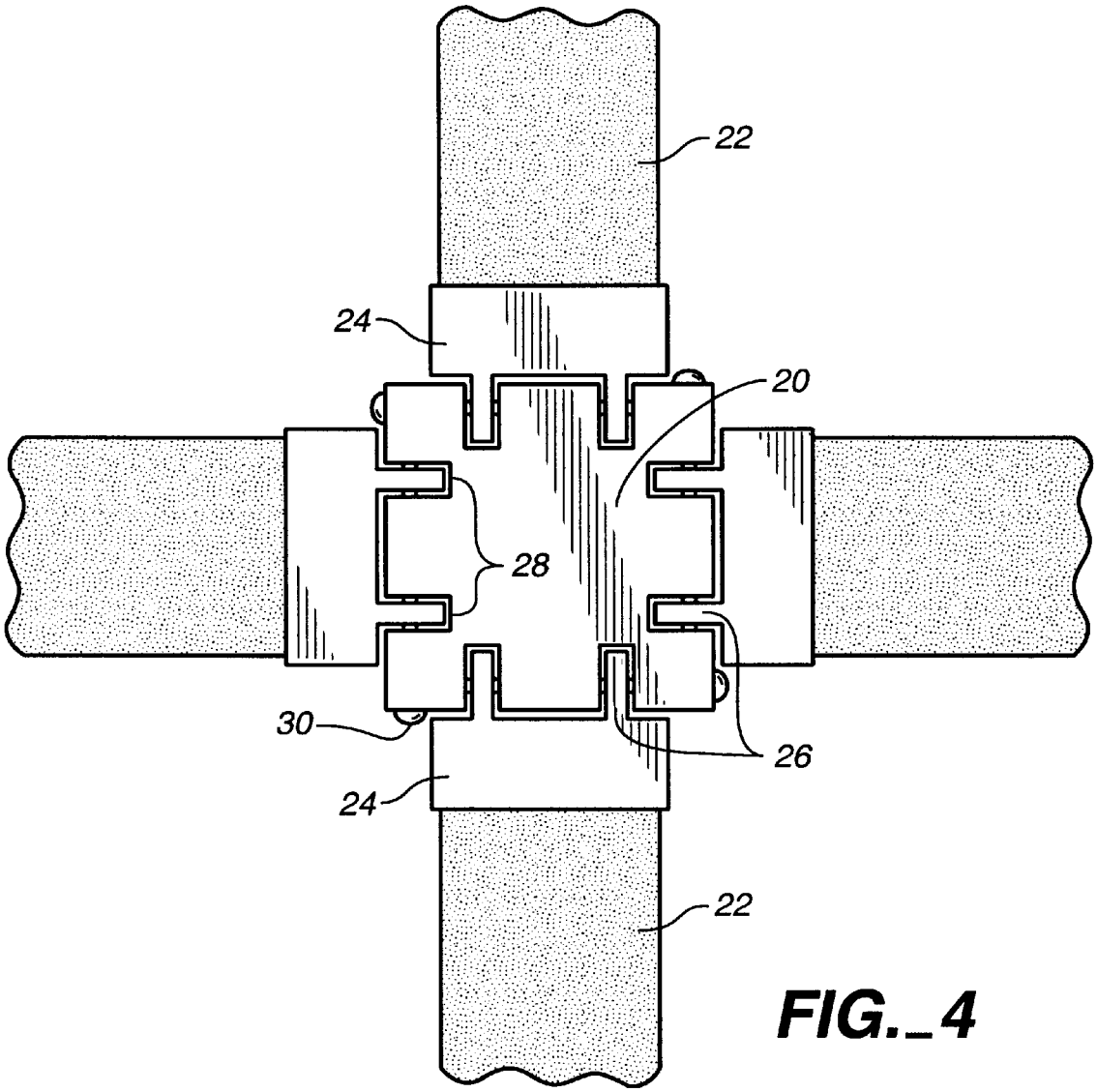
FIG. 4 is an enlarged fragmentary view of a third embodiment of the hub of a throw toy according to the invention.

The preferred embodiment of FIG. 1 shows the straps 16 and hubs 12, 14 as integrally connected. FIG. 4 shows an alternate connection between the hub 20 and straps 22. Each strap 22 has an end portion 24. Dual projections 26 fit freely in recesses 28 of the hub 20. Pivot pins 30 in the sides of the hub 20 pass through the projections 26 of the end portions 24 of the straps 22 and act as a pintle. Accordingly, the straps 22 are hinged about the pivot pins 30 to the hub 20.

Figure 5:
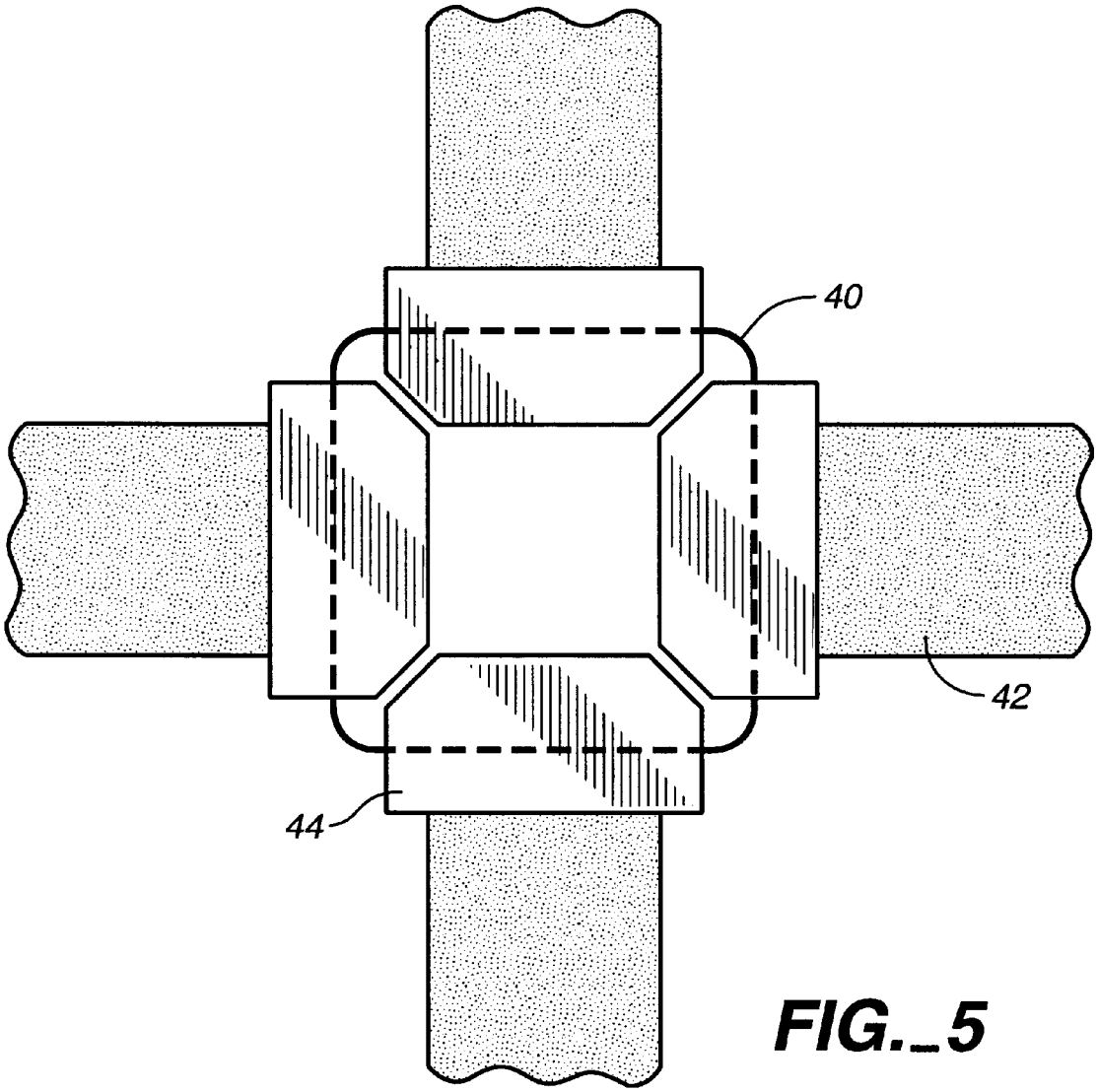
FIG. 5 is an exploded fragmentary view of a fourth embodiment of the hub of a throw toy according to the invention.

FIG. 5 illustrates another embodiment of the hub area of the throw toy 10. In the embodiment shown, the hub has essentially been replaced by a hub ring 40. Similar to the embodiment shown in FIG. 4, each strap 42 has an end portion 44. The hub ring 40 passes through a transverse opening in the end portion 44, such that the strap 42 pivots about the hub ring 40.

Figure 2:
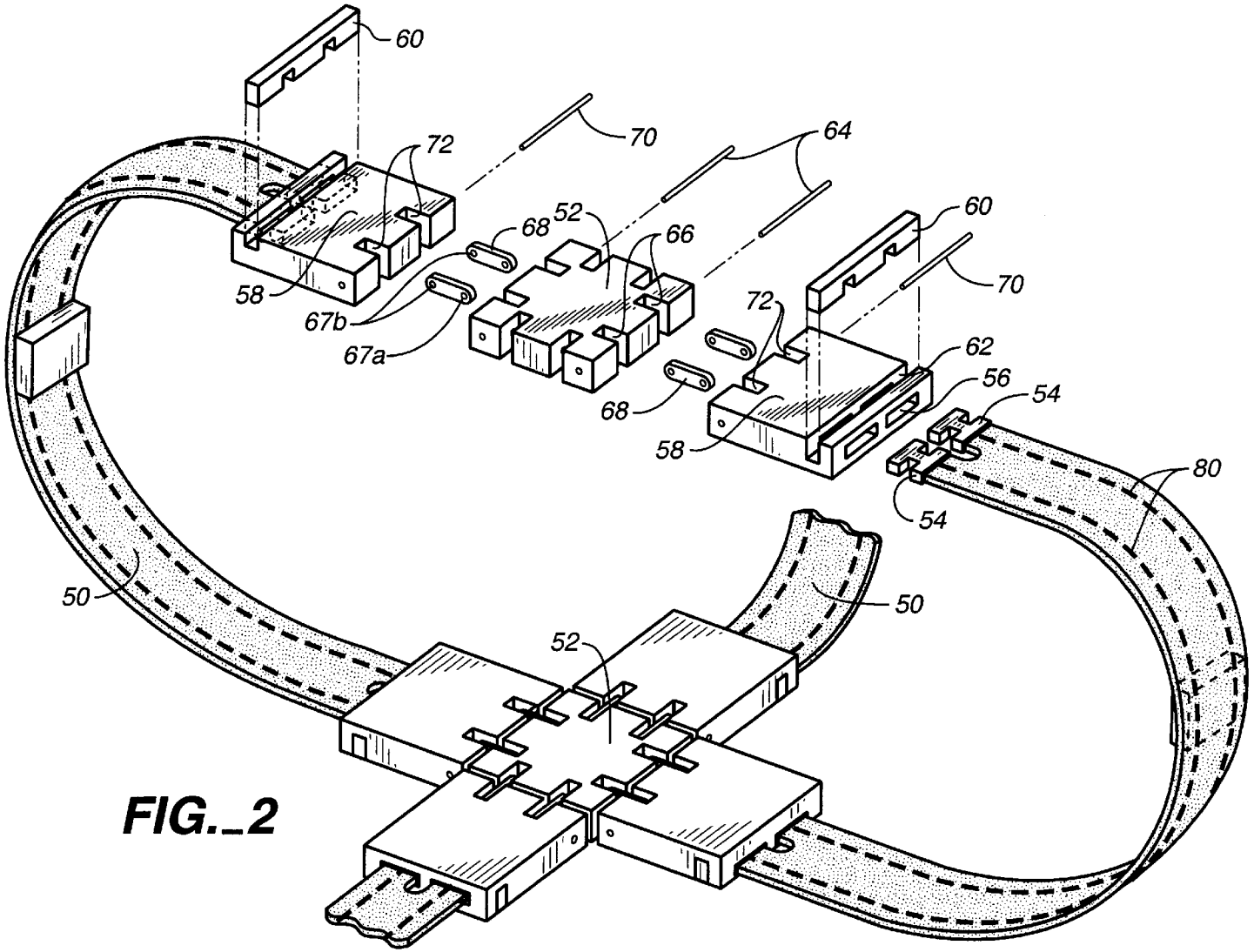
FIG. 2 is a partial fragmentary view of an alternate embodiment of a throw toy according to the invention, showing an exploded view of the hub.

A further embodiment of the invention is illustrated in FIG. 2, showing a more sophisticated mechanism for interconnection of straps 50 and hubs 52. Two buckles 54 are provided at each end of each strap 50. Each buckle 54 is dimensioned to be removably inserted into one of the cavities 56 provided in hinge plates 58. A clip 60 fits in a recess 62 provided in each hinge plate 58. In the preferred embodiment, the clip 60 locks in the channel 62, but can be removed. It can readily be seen that the clips 60 could be made to lock in place but be detachable by making them snap in place through well understood mechanisms or by hinging the clip 60 on one of its lower edges. When the clip 60 is in place in the recess 62, it is in overlapping engagement with buckles 54 fully inserted into cavities 56, as best seen in the left side of FIG. 2. Accordingly, the strap 50 is held in place to the hinge plate 58 by the clip 60. When it is desired to remove and replace the strap 50, the clip 60 is removed, thereby releasing the buckles 54, and a replacement strap is simply and quickly attached to the hinge plates 58 by the reverse operation.

Referring still to FIG. 2, each hub 52 is provided with a plurality of pivot pins 64 inserted in transverse openings through the sides of the hubs 52 passing through slots 66 and holes 67*a* in links 68 freely inserted in the slots 66. Link pins 70 pass through openings 72 in the end of the hinge plates 58 and through holes 67*b* in the other end of links 68. In this manner hinge plate 58 is linked to and pivots off of hub 52.

In the embodiment shown in FIG. 2, wires 80 are embedded in the straps 50 and extend between and connect buckles 54 on each end of the straps 50. Alternate forms of the embodiments illustrated in FIGS. 1, 4, and 5 are also provided with a is plurality of wires running between and connecting the ends of the respective straps therein illustrated.

Figure 3:
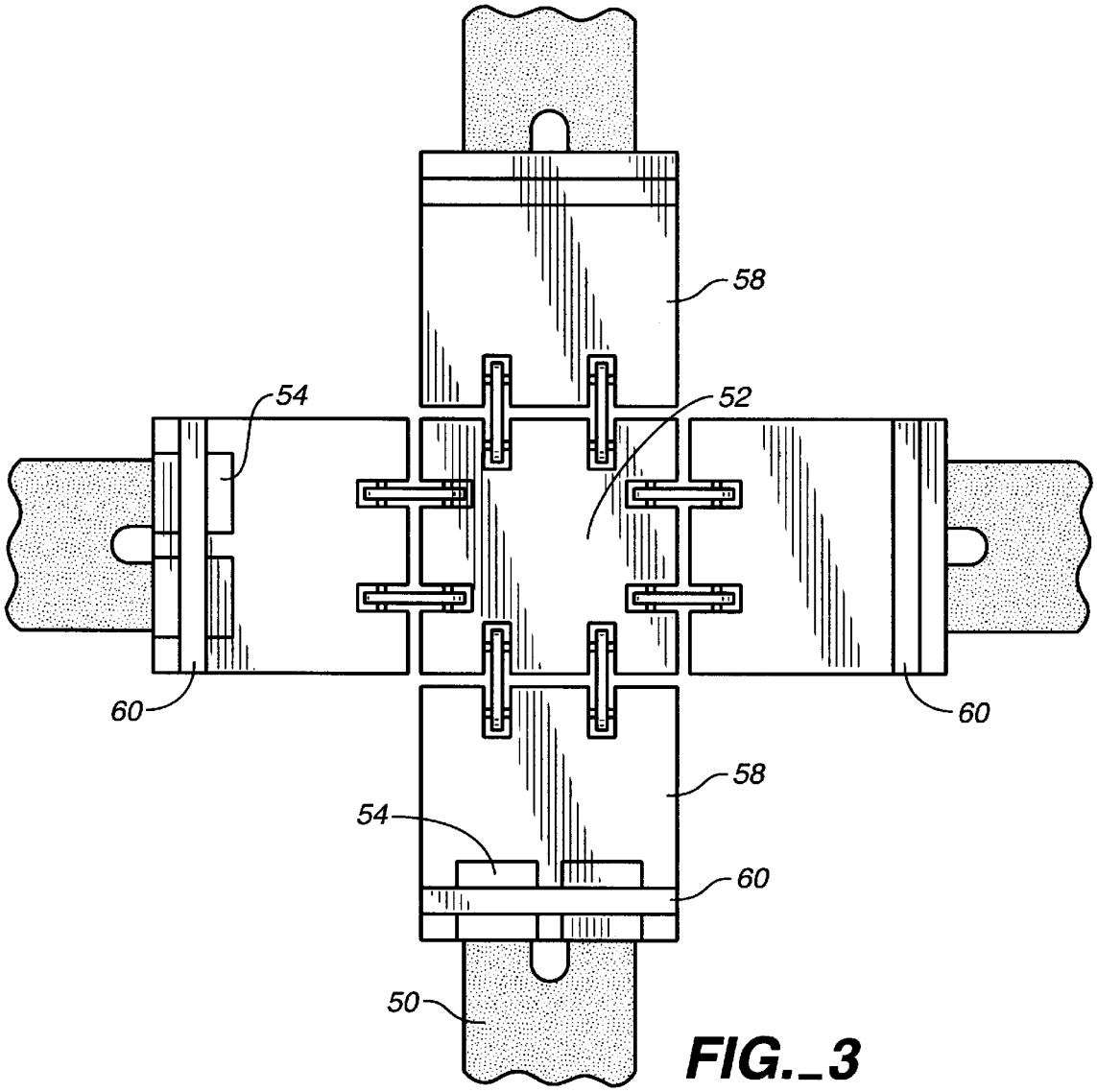
FIG. 3 is an expanded fragmentary view of the hub area of the embodiment of the throw toy shown in FIG. 2.

FIG. 3 is an enlarged fragmentary view of the hub 52, strap 50, and hinge plate 58 of the embodiment shown in FIG. 2. Buckles 54 are shown in dotted line inserted into the cavities 56 of hinge plates 58. The buckles 54 are held in place by clips 60.

There have thus been illustrated several embodiments of a new and improved throw toy. While preferred embodiments have been described and disclosed, it should be recognized by those skilled in the art that modifications are within the true spirit and scope of the invention. The appended claims are intended to cover all such modifications.

I claim:

1. A throw toy comprising:

a first hub, a second hub, and at least three flexible straps disposed between and connecting said first hub and said second hub, said hubs and said straps defining a hollow interior space for airflow therethrough in flight, said hubs and said straps further defining the outermost boundary of said throw toy, said straps having mass greater than said hubs, such that, upon spinning of said straps around said hubs, said straps move radially outward forcing said hubs into closer proximity and bending said straps and said hubs into an oblate shape.

2. The throw toy of claim 1 wherein:

each said strap has two oppositely disposed end portions and a middle portion between said end portions, said middle portion having greater mass than said end portions.

3. The throw toy of claim 1 wherein:

said straps include pairs of oppositely disposed straps, each said strap of each said pair being of a mass equal to the other strap of said pair.

4. The throw toy of claim 1 wherein:

said straps each have mass, and the mass of all of said straps is symmetrically balanced around said hubs.

5. The throw toy of claim 1 wherein:

said straps each have mass, and the mass of all of said straps is balanced evenly around said hubs.

6. The throw toy of claim 1 wherein:

said plurality of straps comprises at least four straps.

7. The throw toy of claim 1 wherein:

said plurality of straps comprises sets of oppositely disposed straps, each said set having mass symmetrically balanced with respect to said hubs.

8. The throw toy of claim 1 wherein:

said straps are of uniform length.

9. A throw toy comprising:

a first hub, a second hub, and a plurality of at least three straps disposed between and connecting said first hub and said second hub, each said strap including a plurality of reinforcing wires, each said wire extending lengthwise the entire length of said strap, said straps having mass greater than said hubs, such that, upon spinning of said straps around said hubs, said straps move radially outward forcing said hubs into closer proximity and bending said straps and said hubs into an oblate shape.

10. A throw toy comprising:

a first hub, and a second hub, said hubs each comprising a plurality of pivot pins, and a plurality of at least three straps disposed between and connecting said first hub and said second hub, said straps having mass greater than said hubs, such that, upon spinning of said straps around said hubs, said straps move radially outward forcing said hubs into closer proximity and bending said straps and said hubs into an oblate shape.

11. The throw toy of claim 10 wherein:

each of said straps has two oppositely disposed end portions, each said respective end portion hinged to one of said hubs at one of said plurality of pivot pins.

12. The throw toy of claim 11 wherein:

each said hub is generally disposed in a plane, and each said end portion swivels in a plane perpendicular to said plane of said to hub to which it is attached.

13. The throw toy of claim 11 wherein:

each of said end portions of said straps has a transverse opening, and each one of said plurality of pivot pins of said hubs passes through said opening of one of said end portions of one of said straps.

14. The throw toy of claim 10 wherein:

each of said end portions of said straps has two end rings, and one of said plurality of pivot pins of said hubs passes through said end rings of one of said end portions of each of said straps.

15. The throw toy of claim 10 wherein:

each said strap includes a plurality of reinforcing wires, each wire extending lengthwise for the entire length of said strap, each said wire having two oppositely disposed end portions, each said end portion having an end loop, and one of said plurality of pivot pins of said hubs passes through one of said end loops of each of said wires of said straps.

16. A throw toy comprising:

a first hub, and a second hub, each said hub having a plurality of pivot pins, and a plurality of at least three straps disposed between and connecting said first hub and said second hub, each of said straps having two oppositely disposed end portions, each said end portion having two links, each of said links pivotally attached to one of said plurality of pivot pins for pivoting movement of said end portion of said strap about said pivot pin, said straps having mass greater than said hubs, such that, upon spinning of said straps around said hubs, said straps move radially outward forcing said hubs into closer proximity and bending said straps and said hubs into an oblate shape.

17. The throw toy of claim 16 wherein:

each said end portion of each of said straps has a transverse link pin, and said links of said end portion are pivotally attached to said link pin for pivoting attachment of said links about said link pin.

18. The throw toy of claim 17 including:

means for detachably connecting each of said straps to said hubs.

19. A throw toy comprising:

a first hub, and a second hub, each said hub having a plurality of cavities, a plurality of at least three straps disposed between and connecting said first hub and said second hub, each of said straps having two oppositely disposed end portions, each said end portion of said straps including a plurality of buckles, each said buckle sized for removable insertion into one of said cavities of said hubs, and a plurality of clips, each said clip removably attached to one of said hubs for retaining said buckles in said cavities, each said clip in overlapping engagement with said plurality of buckles of one of said end portions of one of said straps, such that each said buckle is removably locked in said cavity, said straps having mass greater than said hubs, such that, upon spinning of said straps around said hubs, said straps move radially outward forcing said hubs into closer proximity and bending said straps and said hubs into an oblate shape.

20. The throw toy of claim 19 wherein:

said buckles are each I-shaped.

21. The throw toy of claim 19 wherein:

each said hub includes a plurality of channels, each said channel disposed transversely to said plurality of buckles of one of said end portions of one of said straps, and each said clip is sized to be removably inserted into one of said channels.

22. A throw toy comprising:

a top hub, a bottom hub, a plurality of at least four straps of uniform length disposed between and connecting said top hub and said bottom hub, said straps evenly interspaced angularly about said top and said bottom hubs, said straps having mass greater than said hubs, such that, upon spinning of said straps around said hubs, said straps move radially outward forcing said hubs into closer proximity and bending said straps and said hubs into an oblate shape, each said hub having a plurality of pivot pins, a plurality of links, a plurality of link pins, and a plurality of hinge plates, each of said links pivotally attached to one of said pivot pins for pivoting movement of said link about said pivot pin, each said hinge plate having a link pin, each of said links pivotally attached to one of said link pins for pivoting movement of said link about said link pin, such that said hinge plate pivots on said link pin about said links, each said end portion of said straps including a plurality of buckles, each said hinge plate having a plurality of cavities, each cavity sized to slidingly receive one of said buckles, each said buckle removably inserted into one of said cavities, each said hinge plate further having a clip, said clip removably attached to said hinge plate, each said clip in overlapping engagement with said buckles in said cavities of said hinge plate, such that each said buckle is removably locked in said cavity so that each said strap is detachably connected to said hubs.

* * * * *

UNITED STATES PATENT AND TRADEMARK OFFICE

CERTIFICATE OF CORRECTION

PATENT NO. : 6,089,939

DATED : July 18, 2000

INVENTOR(S) : David B. Dyson

It is certified that error appears in the above-indentified patent and that said Letters Patent is hereby corrected as shown below:

In the title page: Item [75]

Correct address of Inventor : Delete "2811 San Leandro Blvd., #202, San Leandro, Calif. 94578" and insert –2445 Shoreline Drive, #103, Alameda, California 94501–

Column 4, line 29: Delete the word "is"

Column 5, line 45: Delete the first occurrence of the word "to"

Signed and Sealed this

Third Day of April, 2001

*Attest:*

Nicholas P. Godici

NICHOLAS P. GODICI

*Attesting Officer*

*Acting Director of the United States Patent and Trademark Office*